United States Patent [19]

Maus et al.

[11] Patent Number: 5,063,872

[45] Date of Patent: Nov. 12, 1991

[54] PROTECTIVE COVER FOR ELECTRICAL FIXTURE

[76] Inventors: Patricia Maus; Ralph Sievert, both of R.D. #1, Box 716, Lenhartsville, Pa. 19534

[21] Appl. No.: 543,488

[22] Filed: Jun. 26, 1990

[51] Int. Cl.[5] ..... B05C 21/00

[52] U.S. Cl. ..... 118/213; 118/301; 118/504; 118/505

[58] Field of Search ..... 118/213, 504, 301, 505; 16/7 R; 150/154; 200/333; 220/34, 241, 242

[56] References Cited

U.S. PATENT DOCUMENTS

| | | | |
|---|---|---|---|
| D. 279,860 | 7/1985 | Schwalbe | D8/14 |
| D. 297,396 | 8/1988 | Schwalbe | D8/14 |
| 2,398,901 | 4/1946 | West | 206/216 |
| 2,666,546 | 1/1954 | Reilly | 220/3.4 |
| 2,925,064 | 10/1958 | Kahn | 118/505 |
| 3,061,083 | 10/1962 | Hubbell | 220/3.4 |
| 3,386,071 | 4/1966 | Allen | 16/DIG. 2 |
| 4,822,650 | 4/1989 | Horiki | 428/34.2 |

*Primary Examiner*—Richard V. Fisher
*Assistant Examiner*—Brenda Lamb
*Attorney, Agent, or Firm*—Antonelli, Terry, Stout & Kraus

[57] ABSTRACT

The present invention provides a device for protecting a fixture during treatment of the surface on which the fixture is mounted. The fixture itself includes internal elements mounted behind the surface and at least one surface element which is exposed at the surface. The fixture also would normally include a fixture cover mounted on the fixture to cover the internal elements of the fixture and to cover a portion of the surface around the periphery of the fixture, while permitting the surface elements of the fixture to be exposed. In order to protect such a fixture, a protective cover is provided for temporarily replacing the fixture cover during the treatment of the surface. The protective cover includes a portion to cover the internal elements of the fixture to protect them from the surface treatment and a portion to cover the surface elements of the fixture to also protect them from the surface treatment. In addition, an arrangement is provided for securing the protective cover to a predetermined element of the fixture by frictionally fitting said cover to said element. As a preferred embodiment of this, the arrangement for securing the protective cover includes an arrangement for frictionally fitting the cover to one of the surface elements.

5 Claims, 6 Drawing Sheets

FIG. 3′
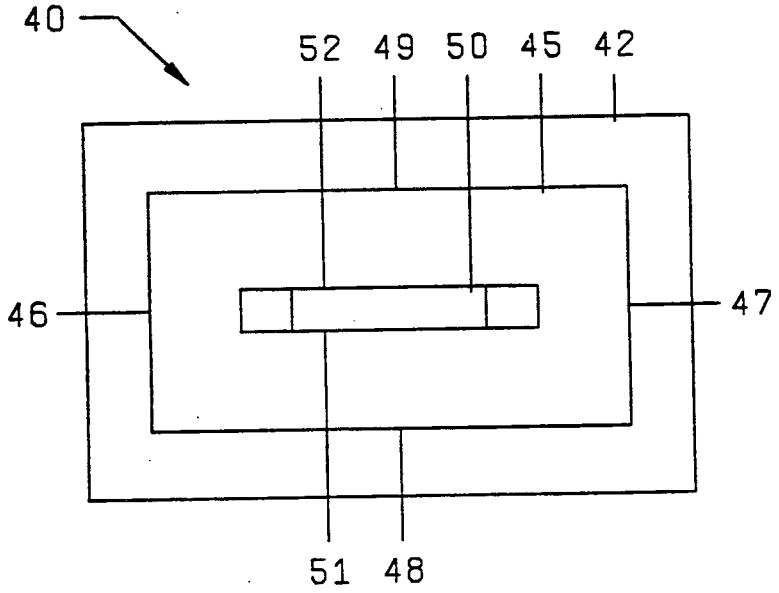
FIG. 4B
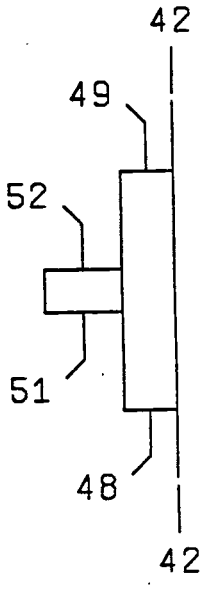
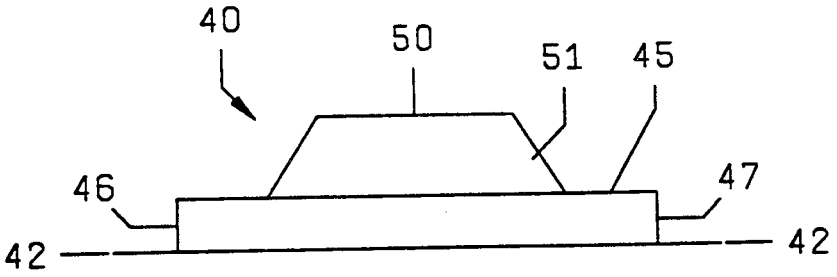
FIG. 4A

FIG. 3"

FIG. 3'''
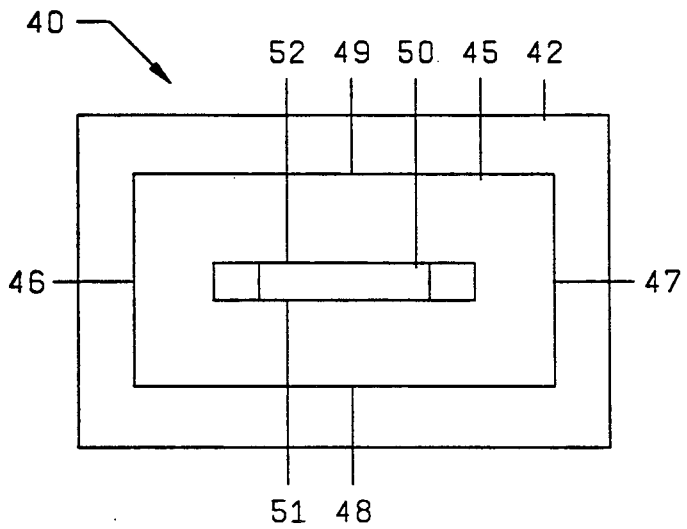
FIG. 6B
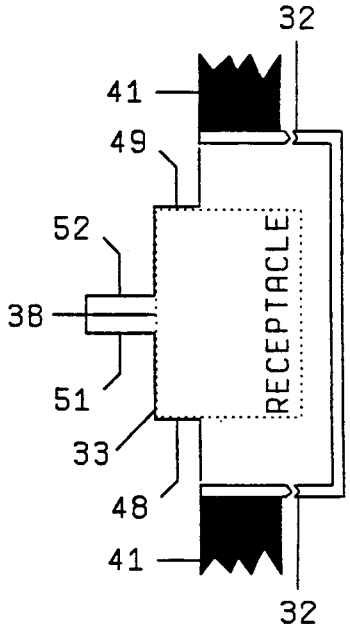
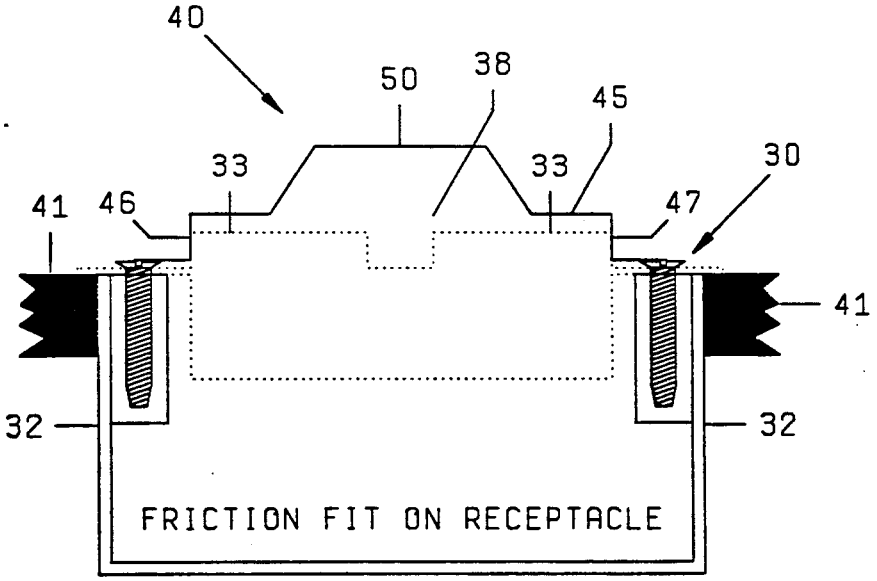
FIG. 6A

PROTECTIVE COVER FOR ELECTRICAL FIXTURE

FIELD OF THE INVENTION

This invention relates to protecting fixtures on a surface for treatment of such surface. More particularly, this invention relates to fixtures on a surface, for example, electrical receptacles and switches, and their protection from treatment such as painting such surface.

BACKGROUND OF THE INVENTION

A typical example of the need for protecting fixtures for surface treatment includes painting interior o exterior surfaces of walls, floors and ceilings of buildings such as found in a dwelling house ("home"). Such surfaces have fixtures mounted partly within and partly upon underlying substrates such as plasterboard, rock lath, wire lath and/or plaster. The fixtures include, but are not limited to, electrical or mechanical service connectors. For example, walls of a home typically have electrical switches mounted so that parts thereof pierce through wall surfaces. Another example includes plug-in type electrical receptacles. Another example includes plug-in or screw-on type sound transmitting and amplifying wall fixtures. A further example includes television transmitting lines having wall connectors. A further example includes telephone line connecting outlets. Even vacuum, air and water service connecting outlet boxes are found in some homes or in commercial buildings such as laboratories A problem in treating surfaces is that the fixtures are often vulnerable to the treating media. For example, electrical devices are particularly vulnerable to water and solution spray often used to wash surfaces or to remove wall paper. Electrical devices become corroded and plug-in slots are often filled with residual materials which cause short circuits. Such vulnerability extends to sound, telephone and television connecting fixtures.

The fixtures are usually installed in boxes set into surfaces of walls, ceilings or floors and generally include plates which provide day-to-day protection from dust, dirt and occasional splashing. However, it is typically desirable to remove such plates for treatment, such as for painting, because the plates often have ornamental designs, permanent coatings or they are made of a smooth, often glossy, decorative material such as chrome metal, copper or plastic. Accordingly, it is typical to remove the plates for some treatments, such as for painting. When the plates are removed, the internal devices, wires, clip, etc., are exposed and are particularly vulnerable to damage.

Heretofore, it has been customary to protect surface fixtures by painstaking measures, for example, by merely brushing around the mounting boxes. Another measure has been to cover the fixtures with a combination of tape and heavy paper. A further measure has been to paint the surfaces before the vulnerable fixtures are installed.

All of the above measures have problems which are time-wasting and expensive. For example, brushing around such fixtures causes uneven paint distribution and it is time-consuming. Furthermore, brushing is unavailable when a preferred method may include spraying the surfaces. Even when paint is applied with rollers, trying to paint around the fixtures is expensive, time-wasting and causes uneven distribution of paint. Even tape and paper coverings are wasteful and time-consuming. Moreover, one must wait until the paint is fully dried because paint accumulated on tape is often sticky, gummy and otherwise unclean. Such coverings and the materials are also expensive because they are typically wasted and cannot be used for repeated surface treatment operations.

U.S. Design Pat. Nos. 279,860 and 297,396, both issued to Schwalbe, are examples of previously designed paint shields for electrical switch plates. These paint shields are apparently both intended to fit over the external cover of the electrical switch plate. As a result, these devices are rather impractical because they will, of necessity, cover an area of the surface being treated which surrounds the periphery of the external cover. When the paint shield is removed, the area of the surface which it covers will appear as an unpainted ring surrounding the external cover of the fixture. Also, because of the tendency of paint to stick to the shield, some of the paint on the surface is likely to be removed when the paint shield is removed. Therefore, the area immediately surrounding the cover of the electrical switch plate will tend to look unattractive and not properly finished.

SUMMARY OF THE INVENTION

Accordingly, it is an object of the invention to provide a means for protecting fixtures for surface treatment.

It is a further object to provide a protective device that is effective to protect vulnerable fixtures.

It is a further object of the present invention to provide a protective device that is reusable, and that can be readily applied and readily removed.

To achieve these and other objects, the present invention provides a device for protecting a fixture during treatment of the surface on which the fixture is mounted. The fixture itself includes internal elements mounted behind the surface and surface elements which are exposed at the surface. The fixture also would normally include a fixture cover mounted on the fixture to cover the internal elements of the fixture and to cover a portion of the surface around the periphery of the fixture, while permitting the surface elements of the fixture to be exposed. In order to protect such a fixture, a protective cover is provided for temporarily replacing the fixture cover during the treatment of the surface. The protective cover includes a portion to cover the internal elements of the fixture to protect them from the surface treatment and a portion to cover the surface elements of the fixture to also protect them from the surface treatment. In addition, an arrangement is provided for securing the protective cover by frictionally fitting said cover to a predetermined element of the fixture. As a preferred embodiment of this, the arrangement for securing the protective cover includes an arrangement for frictionally fitting the cover to one of the surface elements.

BRIEF DESCRIPTION OF THE DRAWINGS

FIGS. 4A and 4B are side views of the protective device of FIG. 3;

FIGS. 6A and 6B are sectional side views of the device of the present invention mounted on a receptacle such as shown in FIG. 2, with these sectional side views being taken along lines 6A and 6B of FIG. 3.

DETAILED DESCRIPTION

Figure 1:
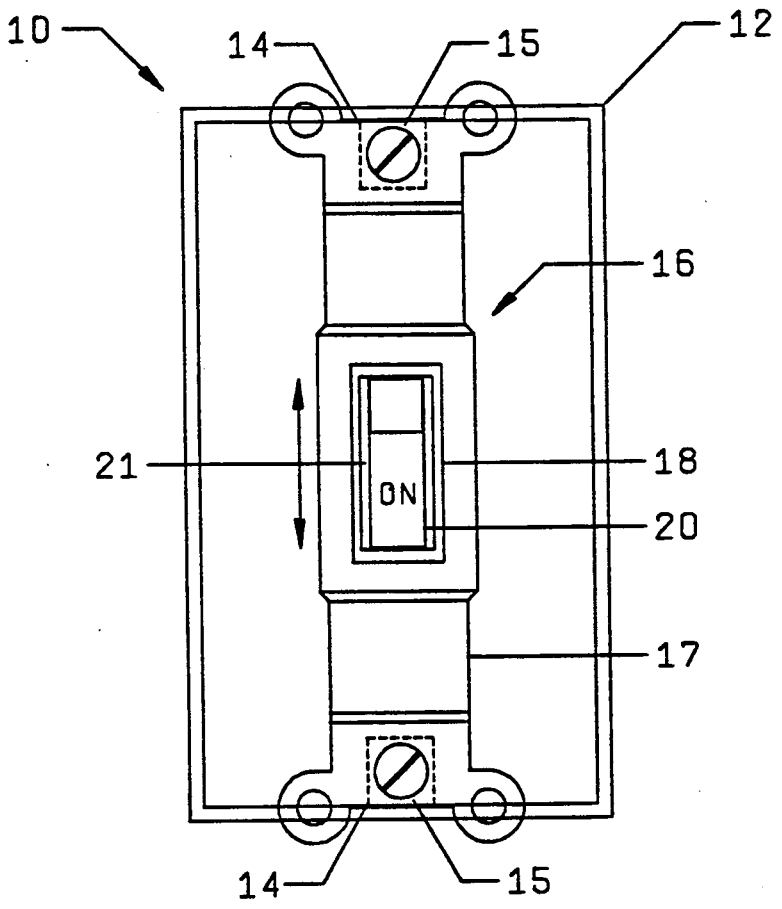
FIG. 1 PRIOR ART
FIG. 1 is a plan view showing an electrical switch fixture for use with the present invention.

FIG. 1 is a plan view showing a surface fixture such as an electrical switch 10 for controlling power to a useful item, such as a lamp, a machine (such as a dishwasher), a fan or another circuit. Switch 10 includes a box 12 for enclosing its other parts and such box contains inwardly extending lugs 14 for mounting a switching device 16 by screws 15.

Switching device 16 includes a bar 17 supporting a central housing 18 to enclose and support electrical contacts and wire connections (not shown). Switching device 16 also includes, within housing 18, a toggle arm 20 which may be moved back and forth according to arrow 21 to close and to open a switching circuit (not shown).

Figure 5B:
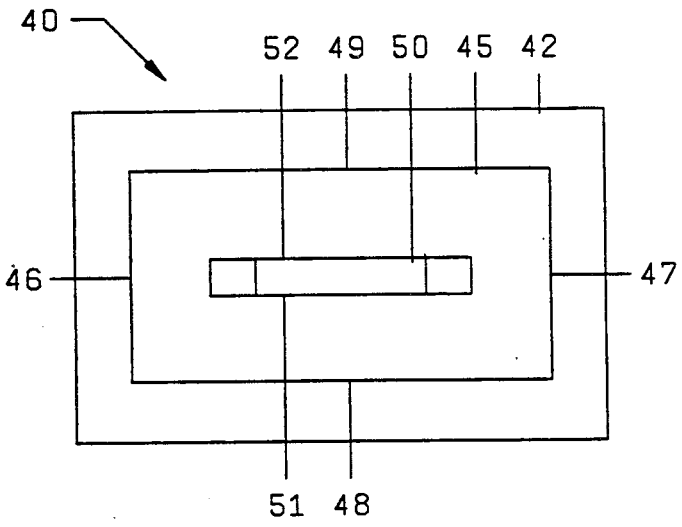
FIGS. 5A and 5B are sectional side views showing the structure of the present invention mounted on an electrical switch plate such as shown in FIG. 1.
Figure 5A:
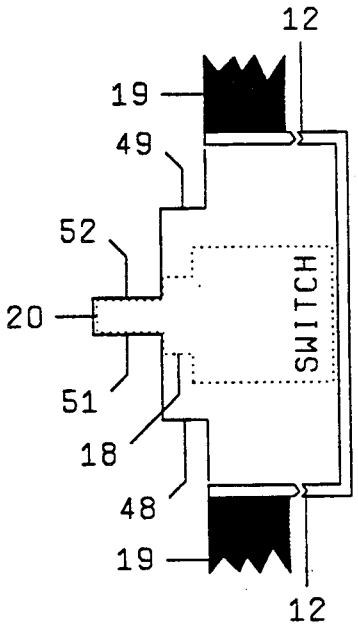
Figure 5A:
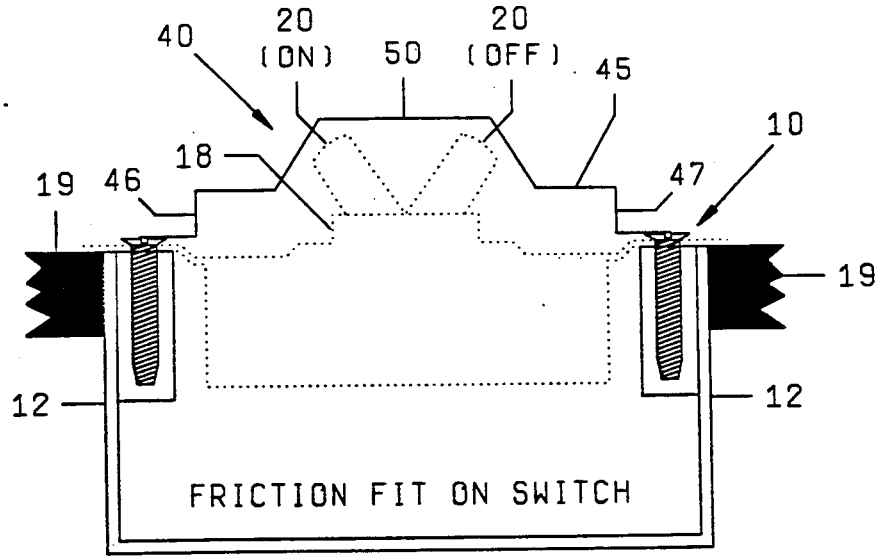

It will be appreciated that switch 10 is shown with its surface plate removed as is typically done to avoid deposition on such plate of paint or other media during a treatment of adjacent surfaces. Certain portions of device 10 protrude above the surfaces to be treated. For example, portions of the central housing 18 and of the toggle arm 20 protrude above an adjacent surface 19 as shown in partial sectional views in FIGS. 5A and 5B. Such protrusions must be accommodated when covering the exposed portions of device 10 shown in FIG. 1. Fortunately, the box 12 and all contents therein are firmly anchored into a wall, ceiling or floor substrate covered by surfaces to be treated. The fact of such anchoring, including arm 20, forms a basis for the instant invention.

Figure 2:
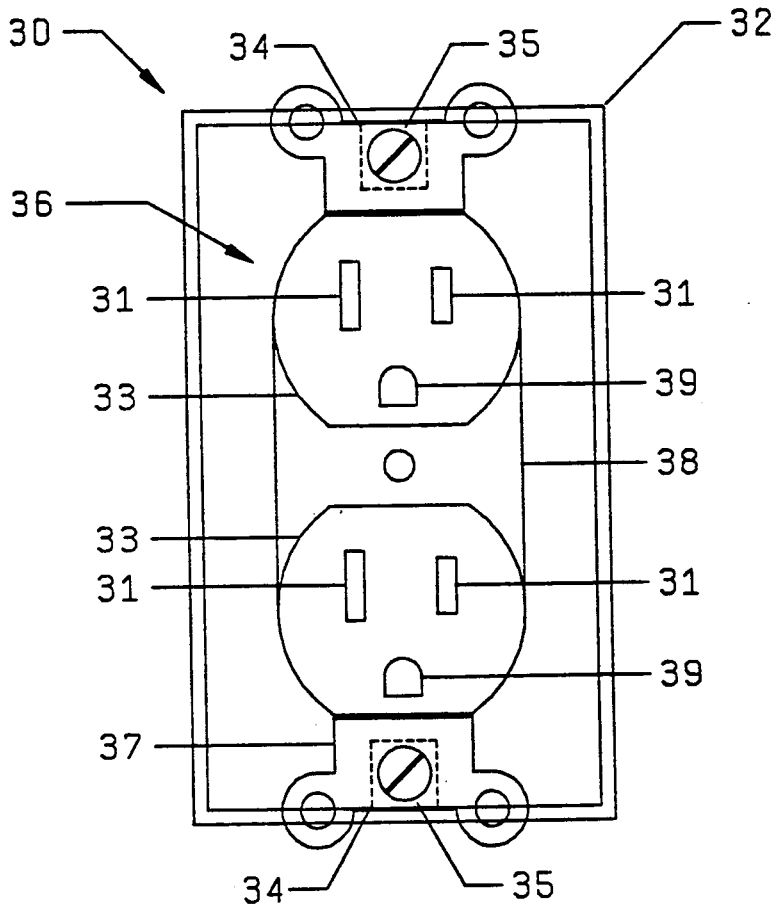
FIG. 2 PRIOR ART
FIG. 2 is a plan view showing an electrical outlet for us with the present invention.
Figure 7:
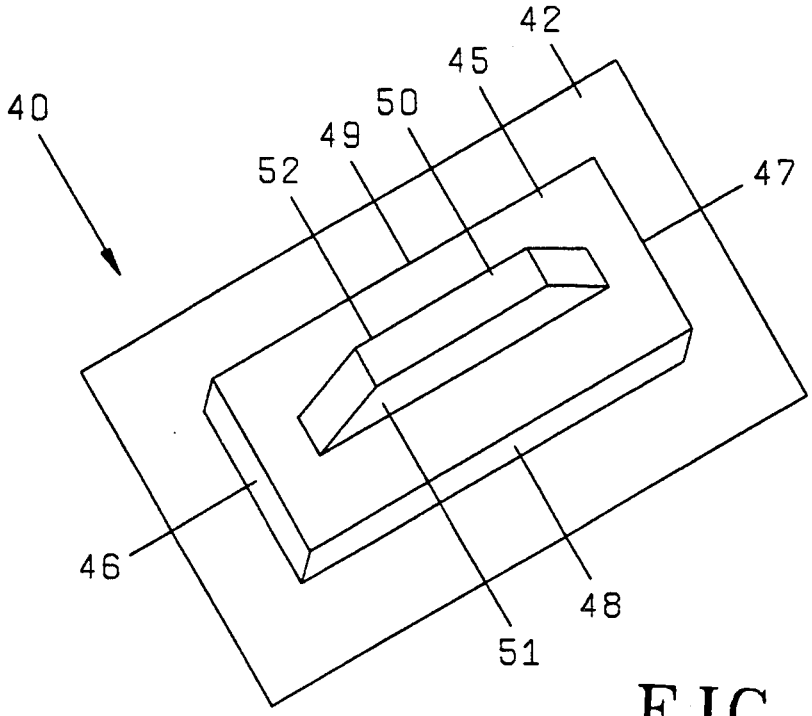
FIG. 7 is a perspective view of the protective device.

FIG. 2 is a plan view of another surface fixture such as an electrical receptacle or outlet 30 for cords of electrical equipment (not shown) by plugs into an electrical circuit (not shown). Receptacle 30 includes box 32 for enclosing its other parts and such box contains inwardly extending lugs 34 for mounting electrical plugging twin device 36 by screws 35.

Device 36 includes a bar 37 supporting a central housing 38 for enclosing and supporting electrical contacts and wire connectors (not shown). Housing 38 also includes raised portions 33 which are made of an insulative, often decorative material such as colored, glossy plastic. Within each portion 33, there is a pair of slots 31 and a cavity 39 for plugging unshown prongs of electrical plugs attached to cords of electrical equipment (not shown) to receive electrical power.

It will be appreciated that receptacle 30 is shown with its surface plate removed for the same reasons explained for switch 10. Certain portions of a receptacle 30 may protrude above the surfaces to be treated. For example, the plug-in portions 33 typically protrude above adjacent surface 41 as shown in partial sectional views in FIGS. 6A and 6B. Such protrusions should be accommodated when protecting the exposed portions of device 30 shown in FIG. 2. Fortunately, the box 32 and its contents including plug-in portions 33 are firmly anchored in surface substrates forming a basis for the instant invention.

Figure 3:
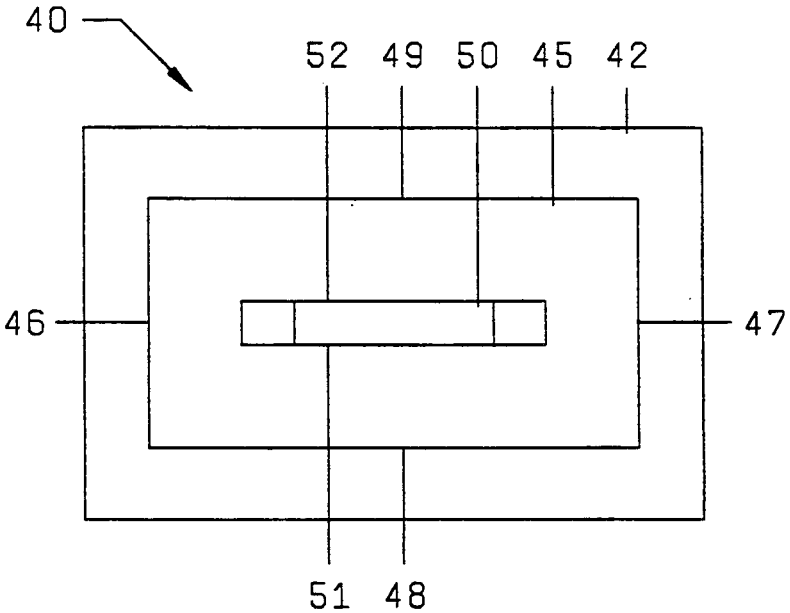
FIGS. 3, 3', 3'' and 3''' are identical plan views showing a first embodiment of the present invention which can be used with either FIG. 1 or FIG. 2.

Apparatus of the invention is shown in FIGS. 3 to 6B. FIG. 3 is a plan view of a removable fixture protector 40 which is representative of this invention. FIGS. 4A, 5A and 6A are partial sectional views of protector 40 taken along lines 4A, 5A, 6A, respectively, and FIGS. 4B, 5B and 6B are partial sectional views of protector 40, taken along lines 4B, 5B, 6B, respectively.

Protector 40 is preferably made from a formable material such as heat and/or pressure-formable plastic such as a styrene polymer (for example, polystyrene or a styrene co-polymer), polyethylene, polycarbonate or similar material which is obtainable in thin sheet form. Such materials are also pliable and readily cleaned. Moreover, sheets of such material, when formed as shown in the figures, tend to retain the formed shapes.

Protector 40 is desirably constructed to protect, interchangeably, both switches 10 and receptacles 30 having the characteristics explained above and which are installed in boxes 12 and 32 having similar dimensions. Accordingly, protector 40 may have the external dimensions shown in FIG. 3 which adequately covers all vulnerable portions of a fixture 10 or 30. Protector 40 has an apron 42, a first, large, raised portion 45 and a second, higher raised portion 50. Portion 45 is raised to fit over housing 18 of switch 10 and to fit around housing 38 (and particularly plug portions 33) of receptacle 30.

To protect switch 10, protector 40 has its second raised portion 50 made high enough and sufficiently wide (FIGS. 4A–B and 5A–B) to fit around toggle arm 20. Note for switch 10, the second portion 50 has sides 51 and 52 which are sufficiently close together to cause a snap fit when arm 20 is lodged therebetween. Note in FIG. 5A that arm 20 may be in the ON or in the OFF position when protection 40 is snapped onto switch 10 for surface treatment. The dimensions shown in FIGS. 4A–B are preferred for the switch 10 described herein and typically found in today's homes.

Protector 40 is also preferred to protect receptacles 30 when installed in the manner shown in FIGS. 6A–B. First, raised portion 45 has sides 46 and 47 which are set far enough apart to accommodate housing 38 and sides 48 and 49 which are set sufficiently close to cause a snap fit on either side of housing 38.

It is found that protectors 40 are readily installed and readily removed for reuse in treating surfaces having vulnerable fixtures. Such protectors can have aprons 42 made larger or smaller and in different configurations than that shown in the figures. Moreover, such protectors may have raised portions of differing configurations to accommodate fixed portions of a surface fixture It will also be appreciated that protectors according to the invention may be applied to surface fixtures by means other than by snap-fit raised portions. For example, the raised portions may have compressible inside liners to grasp an arm 20 or a housing 38. There may be molded into protectors, mechanical clips (not shown) with spring features to fit into and friction fit to a box 12 or 32. There may be applied to such protectors magnets (not shown) which adhere to fixtures because of the typical presence of iron metal such as in support bars 17 and 37. Readily removed, adhereable material such as double stick tape or rubber cement may be used, for example, between an apron 42 and surfaces 19 or 41 to removably attach such protectors. Alternatively, removable threaded elements may be used to supplement the frictional holding arrangement.

Other formable materials in sheet or moldable form may be employed to make such protectors. For example, thin metal sheet may be obtained with forming characteristics and snap-fit retention qualities. Even paper, with or without plastic or other stiffening impregnation, may be utilized to make such protectors in the practice of the invention.

It is to be understood that the above-described arrangements are simply illustrative of the application of the principles of this invention. Numerous other arrangements may be readily devised by those skilled in the art which embody the principles of the invention and fall within its spirit and scope.

We claim:

1. A multi-purpose protective device for protecting at least one of an electrical fixture selected from a group consisting of an electrical switching fixture and an outlet, during treatment of a surface on which said electrical switching fixture or said outlet is mounted with a predetermined treatment agent, wherein said electrical switching fixture includes internal elements mounted behind said surface, a toggle switch exposed at the surface to permit operation of an apparatus coupled to the fixture, and a fixture cover normally mounted on the fixture to cover said internal elements of said fixture and a portion of the surface around a periphery of the fixture while permitting said toggle switch to be exposed, and wherein said outlet includes internal elements mounted behind said surface, a plug-in portion exposed at the surface to permit connection of an apparatus to said outlet, and an outlet cover normally mounted on said outlet to cover said internal elements and to cover a portion of the surface around a periphery of the outlet while permitting said plug-in portion of said outlet to be exposed, wherein said device comprises:

a protective cover for temporarily replacing eithe said fixture cover or said outlet cover during sai treatment of the surface, wherein said protectiv cover includes:

means for covering said internal elements of eithe said electrical switch fixture or said outlet t protect said internal elements from contact wit said treatment agent during said surface treat ment;

means for covering said toggle switch of said elec trical switch fixture to protect it from said sur face treatment; and means for covering said plug-in portion of sai outlet to protect it from said surface treatment, wherein said means for covering said toggle switc is configured to frictionally fit over and friction ally engage said toggle switch to secure sai protective cover to said electrical switch fixtur during said surface treatment, and wherein said means for covering said plug-in por tion of said outlet is configured to frictionally fi over and frictionally engage said plug-in portion to secure said protective cover to said outle during said surface treatment, whereby said multi-purpose protective device can be used selectively to protect either an electrical switch fixture or an outlet during treatment o said surface.

2. A device according to claim 1, wherein said means for covering said toggle switch further includes supplemental means to fix said protective cover to said fixture.

3. A device according to claim 2, wherein said supplemental means comprises a magnet.

4. A device according to claim 2, wherein said supplemental means comprises an adhesive element.

5. A device according to claim 2, wherein said supplemental means comprises a removable threaded element.

* * * * *